US006831546B2

(12) United States Patent
Kaltenborn et al.

(10) Patent No.: US 6,831,546 B2
(45) Date of Patent: Dec. 14, 2004

(54) IMPACT SIGNALING SYSTEM FOR A HIGH-VOLTAGE PROTECTIVE DEVICE

(75) Inventors: Uwe Kaltenborn, Baden-Dättwil (CH); Guido Hoffmann, Wettingen (CH)

(73) Assignee: ABB Research LTD, Zurich (CH)

( * ) Notice: Subject to any disclaimer, the term of this patent is extended or adjusted under 35 U.S.C. 154(b) by 0 days.

(21) Appl. No.: 10/449,514

(22) Filed: Jun. 2, 2003

(65) Prior Publication Data

US 2003/0227367 A1 Dec. 11, 2003

(30) Foreign Application Priority Data

Jun. 7, 2002 (EP) ..... 02405461

(51) Int. Cl.[7] ..... H01H 85/30

(52) U.S. Cl. ..... 337/244; 337/241; 337/206; 337/267; 116/281; 324/550

(58) Field of Search ..... 337/206, 247, 337/241, 244, 265, 267; 439/490, 491; 324/507, 550; 361/835; 81/3.8; 116/281, 283; 340/638, 639

(56) References Cited

U.S. PATENT DOCUMENTS

| | | | | | |
|---|---|---|---|---|---|
| 1,834,578 | A | * | 12/1931 | Conrad | 337/222 |
| 2,111,749 | A | * | 3/1938 | Bussmann | 337/164 |
| 2,306,153 | A | * | 12/1942 | Biermanns et al. | 337/244 |
| 2,320,494 | A | * | 6/1943 | Wallace | 337/244 |
| 2,343,224 | A | * | 2/1944 | Powell | 337/244 |
| 2,417,268 | A | * | 3/1947 | Powell | 337/244 |
| 2,421,658 | A | * | 6/1947 | Strang et al. | 337/244 |
| 2,524,101 | A | * | 10/1950 | Earle | 337/31 |
| 2,797,279 | A | * | 6/1957 | Brandt et al. | 337/244 |
| 2,914,636 | A | * | 11/1959 | Kozacka | 337/244 |
| 3,134,874 | A | * | 5/1964 | Cameron | 337/159 |
| 3,281,557 | A | * | 10/1966 | Fister | 337/244 |
| 3,342,964 | A | * | 9/1967 | Kozacka | 337/164 |
| 3,391,369 | A | * | 7/1968 | Kozacka | 337/232 |
| 3,483,502 | A | * | 12/1969 | Mikulecky | 337/244 |
| 3,523,264 | A | * | 8/1970 | Feenan | 337/161 |

(List continued on next page.)

FOREIGN PATENT DOCUMENTS

| | | | | |
|---|---|---|---|---|
| CH | 219782 | | 6/1942 | |
| DE | 902879 | | 1/1954 | |
| DE | 37012 | | 5/1970 | |
| DE | 1763084 | | 2/1972 | |
| DE | 3337380 | A1 | 4/1985 | |
| DE | 29605370 | U1 | 7/1996 | |
| DE | 10022241 | A1 | 11/2001 | |
| FR | 2591030 | A3 * | 6/1987 | H01H/85/30 |

OTHER PUBLICATIONS

"HV–fuse links with temperature limiter", SIBA Sicherungen–Bau GmbH publication, Lunen, Germany, Nov. 1997, pp. 2–8.

*Primary Examiner*—Anatoly Vortman
(74) *Attorney, Agent, or Firm*—Burns, Doane, Swecker & Mathis, L.L.P.

(57) ABSTRACT

The impact signaling system (9) is used in a high-voltage protective device and has a housing (13), a spring (16) which is arranged in the housing (13) and has a moveable end, an actuator (17) which can be passed out of the housing (13) and interacts with the moveable end of the spring (16), a high-resistance resistor wire (12) which is connected in parallel with a fusible wire of the protective device, and a holder which absorbs the prestress of the spring (16). The holder contains a section of the high-resistance resistor wire (12) which is in the form of a winding (18) and is passed at least once around the moveable end of the spring (16) in order to form the prestress, and which is at least partially in thermally conductive contact with the material of the activator (20). Above a limit temperature, the activator (20) lifts, for example by destruction of the winding (18) or by melting through, the holder and activates the impact signaling system (9) by reducing the load on the spring (16).

10 Claims, 2 Drawing Sheets

U.S. PATENT DOCUMENTS 3,535,668 A * 10/1970 Cinquin ..... 337/244
3,593,249 A * 7/1971 Sedgwick ..... 337/113
3,601,739 A * 8/1971 Blewitt ..... 337/244
3,621,433 A * 11/1971 Belcher ..... 337/244
3,636,491 A * 1/1972 Cameron ..... 337/244
3,678,430 A * 7/1972 Gaia ..... 337/159
3,747,041 A * 7/1973 Cameron ..... 337/159
3,832,665 A * 8/1974 Belcher ..... 337/244
3,895,338 A * 7/1975 Gray et al. ..... 337/244
4,060,786 A * 11/1977 Cuzzone ..... 337/244
4,085,396 A * 4/1978 Augis et al. ..... 337/290
4,156,225 A * 5/1979 Cuzzone ..... 337/244
4,204,182 A * 5/1980 Knapp, Jr. ..... 337/244
4,306,212 A * 12/1981 Belcher ..... 337/244
4,323,872 A * 4/1982 Fontaine ..... 337/158
4,323,874 A * 4/1982 Link ..... 337/244
4,511,876 A * 4/1985 Urani ..... 337/244
4,617,544 A * 10/1986 Mooz et al. ..... 337/3
4,788,622 A * 11/1988 Cinquin ..... 361/124
5,319,344 A * 6/1994 Mosesian et al. ..... 337/244
5,367,281 A * 11/1994 Crooks ..... 337/417
5,886,613 A * 3/1999 Magoon et al. ..... 337/244
5,892,427 A * 4/1999 Handcock ..... 337/229
6,256,183 B1 * 7/2001 Mosesian ..... 361/104

* cited by examiner

IMPACT SIGNALING SYSTEM FOR A HIGH-VOLTAGE PROTECTIVE DEVICE

FIELD OF THE INVENTION

The invention is based on an impact signaling system for a high-voltage protective device having a housing, having a spring which is arranged in the housing and has a moveable end, having an actuator which can be passed out of the housing and interacts with the moveable end, having a high-resistance resistor wire which is connected in parallel with a fusion wire of the protective device, and having a holder which absorbs the prestress of the spring and can be raised with the aid of an activator above a limit temperature with the load on the spring at the same time being relieved, wherein the holder contains a section of the high-resistance resistor wire which is in the form of a winding and is passed at least once around the moveable end of the spring in order to form the prestress. An impact signaling system such as this has various functions. First of all, the system ensures that a signal is produced in some way, be this optical, acoustic and/or electrical, that the high-voltage protective device has tripped as a result of the currents D passing through the protective device and/or the prevailing ambient temperature. Secondly, the system can also be used in a circuit with a switch/protective device combination to interrupt the current flowing in the circuit, by tripping the switch. In this case, the expression high voltage means rated voltages of more than 1 kV, but in particular rated voltages up to approximately 100 kV. The invention also relates to a high-voltage protective device with this impact signaling system, and to a switch/protective device system with this protective device.

BACKGROUND OF THE INVENTION

In the introduction, the invention refers to a prior art of impact signaling systems as is described in the Company Document HTB—11/97 "HH-Sicherungseinsätze mit Temperaturbegrenzer" [HV HRC fuse links with a temperature limiter] from SIBA Sicherungen-Bau GmbH, Borker Strasse 22, D-44534 Lunen. One impact signaling system which is described in this publication is used in protective devices for medium-voltage switchgear assemblies, that is to say at rated voltages of typically 10, 20 or 30 kV, and has a cylindrical symmetrical housing in which a prestressed helical spring and a pin (which is guided in the interior of the helical spring, absorbs the prestress and is composed of thermoplastic material) are arranged. One end of the prestressed spring, which points upward, is supported on a lower end of the impact signaling device which is in the form of a bolt, and its upper end is passed out of the housing. A high-resistance resistor wire which is connected in parallel with a fusible wire of the protective device is passed in a thermally conductive manner around the housing. The thermoplastic pin acts as a fusible activator which melts above a predetermined limit temperature and in the process reduces the load on the spring and hence trips the impact signaling device. The fusible activator can be activated firstly by the temperature in the protective device being raised above the limit temperature by influences within the protective device, such as long-lasting overcurrents, or external influences, such as heat being supplied from the switchgear assembly or by radiation. Secondly the fusible activator can also be activated when, at a time when the current flowing in the protective device is being limited, the current which is commutated from the low-resistance fusible wire of the protective device into the high-resistance resistor wire heats the fusible activator quickly to the limit temperature.

The activator which causes the abovementioned impact signaling system to be activated is composed of thermoplastic material. However, in general, a thermoplastic has a very wide temperature range in which the strength characteristics of the material are relieved gradually, first of all by softening and later by crystallite melting. It is thus impossible to reliably preclude a wide scatter in the behavior when this impact signaling system trips.

SUMMARY OF THE INVENTION

The invention, as it is defined in the patent claims, achieves the object of specifying an impact signaling system of the type mentioned initially which, using simple means, allows a high-voltage protective device to trip reliably in a relatively narrow temperature range.

In the impact signaling system according to the invention, the prestressing force of the spring is absorbed by a section of the high-resistance resistor wire which is in the form of a winding and is passed at least once around the moveable end of the spring, forming the prestress, and which is at least partially in thermally conductive contact with the material of the activator. These measures considerably reduce any scatter in the tripping of the impact signaling system, since the activator now no longer needs to apply the holding force for the prestressed spring, and the holding force now just has to be overcome by removal of the wire winding. Since these two functions are decoupled in the subject matter of the invention, the activator need now no longer have a strength which is sufficiently large to fix the prestressed spring. The activator may thus be composed, irrespective of its strength, of a material which carries out a phase transition, which results in the cancelation of the holding force of the prestressed spring, in a narrow temperature range. This results in the impact signaling system being tripped in a manner subject to only a small amount of scatter, using simple means.

If the activator has a high-energy material with an amount of energy which can be released above the limit temperature which is sufficient to melt the wire winding, then a limit temperature can be achieved which generally fluctuates by approximately ±10° C. The impact signaling system provided with such an activator according to the invention then has a correspondingly narrow scatter width. Particularly suitable high-energy materials contain a combustible material in particular such as a guanidine or a guanidine derivative, an oxidant which reacts with the combustible material on reaching the limit temperature releasing, in particular such as a nitrate, chlorate, perchlorate and/or permanganate, and possibly a binding agent, in particular such as a paraffin or a polymer. These high-energy materials are described in DE 100 22 41 A1.

A particularly simple impact signaling system is achieved if the activator mechanically fixes the wire winding. Once the activator has been tripped, the point fixing is overcome, and the turns of the winding are open, with the load on the spring at the same time being relieved. The activator is in the form of a point, and fixes the wire winding on the spring, in a manner which is particularly advantageous for mass production. If the activator contains an alloy which melts at the limit temperature, in particular based on silver, copper and/or aluminum, doped with indium and/or germanium, then the impact signaling system according to the invention has a particularly narrow tripping scatter width since the fusion temperature fluctuates only by a few ° C.

Furthermore, the fusion temperature of the alloy and hence the tripping characteristic of the impact signaling system can be varied in a simple manner by varying the doping ratios. Suitable alloys are described in the abovementioned De 100 22 241 A1.

The impact signaling system according to the invention is particularly compact if the spring is in the form of a helical spring and is supported on the housing by a fixed end which is arranged opposite the moveable end, and if the prestress is absorbed by the wire winding which is passed around the moveable end and the fixed end of the spring.

BRIEF DESCRIPTION OF THE DRAWINGS

The invention will be explained in the following text with reference to exemplary embodiments. In the figures.

DETAILED DESCRIPTION OF THE INVENTION

Figure 1:
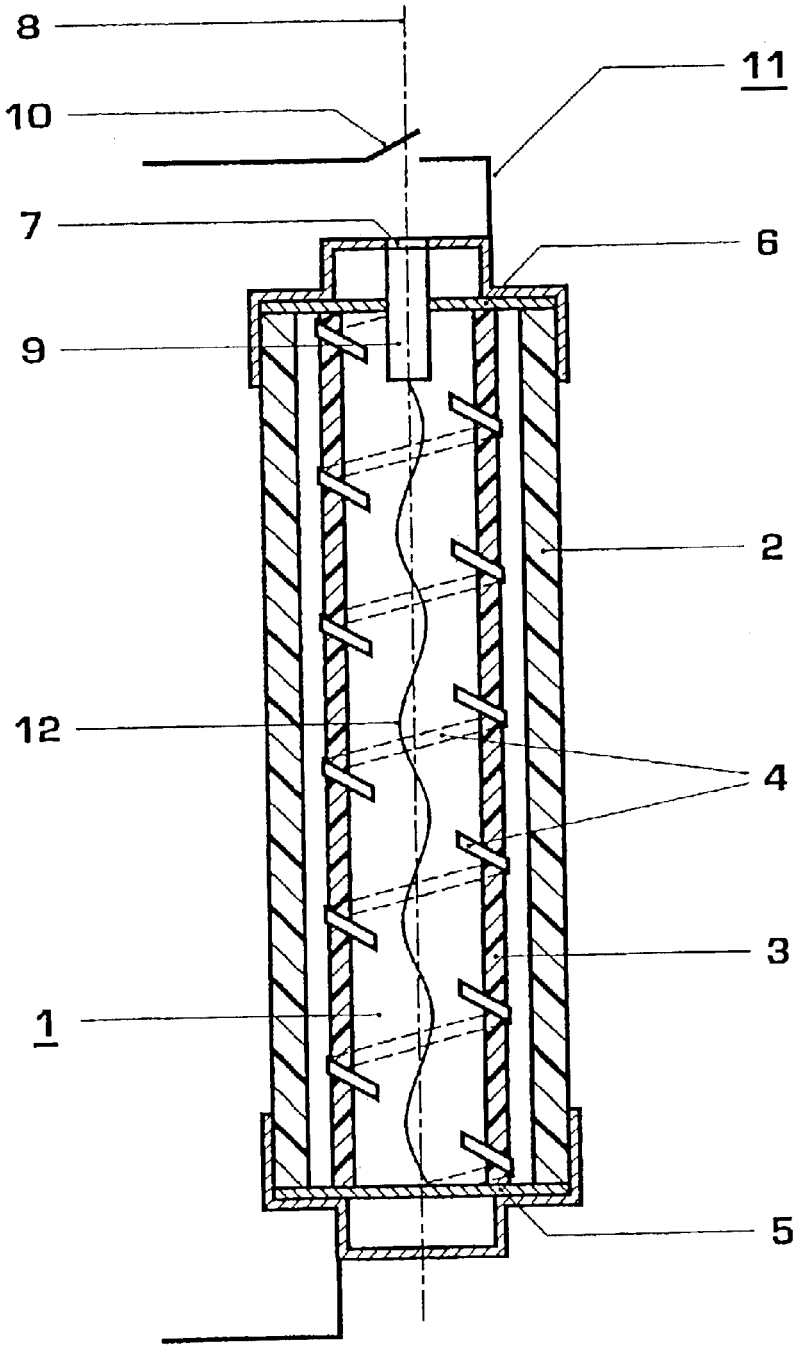
FIG. 1 shows a plan view of a high-voltage protective device, illustrated in sectioned form, with a schematically illustrated impact signaling system according to the invention.

Identical parts are identified by the same reference symbols in the figures. The high-voltage protective device 1 illustrated in FIG. 1 has a hollow-cylindrical housing 2 which is generally made of ceramic and in which a supporting body 3, which is likewise generally made of ceramic, is held fixed in a coaxial arrangement. Low-resistance fusible conductors 4 which are wound in the form of a helical line are arranged on the supporting body 3 and their ends are connected firstly to a power connection 5, which is attached to the lower end of the housing 2 and is in the form of a cap, and secondly to a power connection 6, which is attached to the upper end of the housing 2 and is in the form of a cap. The power connection 6 has an opening 7 through which a part (not illustrated in FIG. 1), which can move in the direction of the housing axis 8, of an impact signaling system 9 which is attached to the power connection 6 can be passed. This part interacts with a switch 10 (which is connected in series with the high-voltage protective device 2) of a switch/protective device system 11. Furthermore, a high-resistance resistor wire 12, which is passed into the impact signaling system 9, is provided in the interior of the protective device housing 2. This wire is connected to the two power connections 5 and 6 and is thus connected in parallel with the fusible conductor 4.

Figure 2:
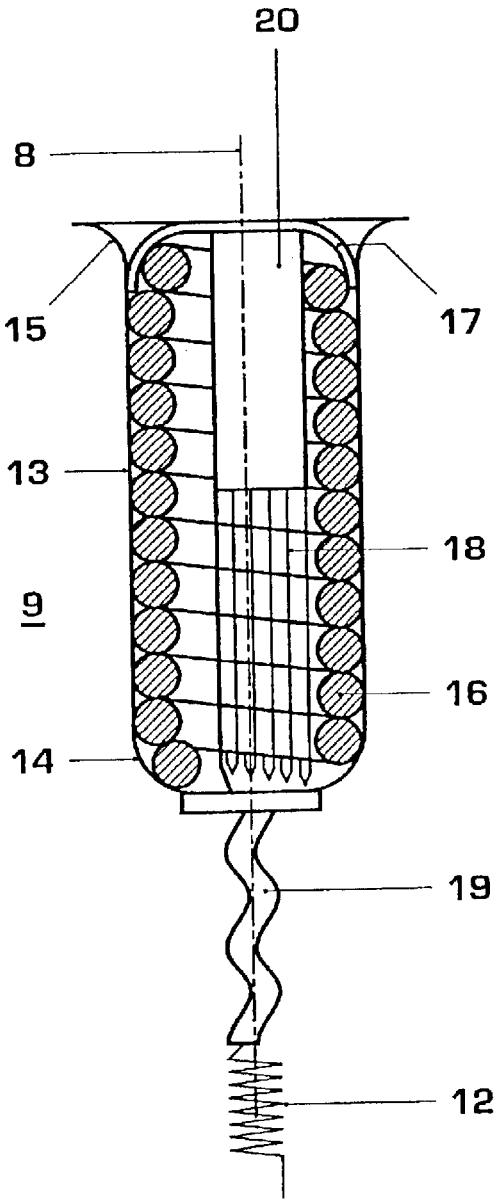
FIG. 2 shows a plan view of a first embodiment, illustrated partially sectioned, of the impact signaling system as shown in FIG. 1.
Figure 3:
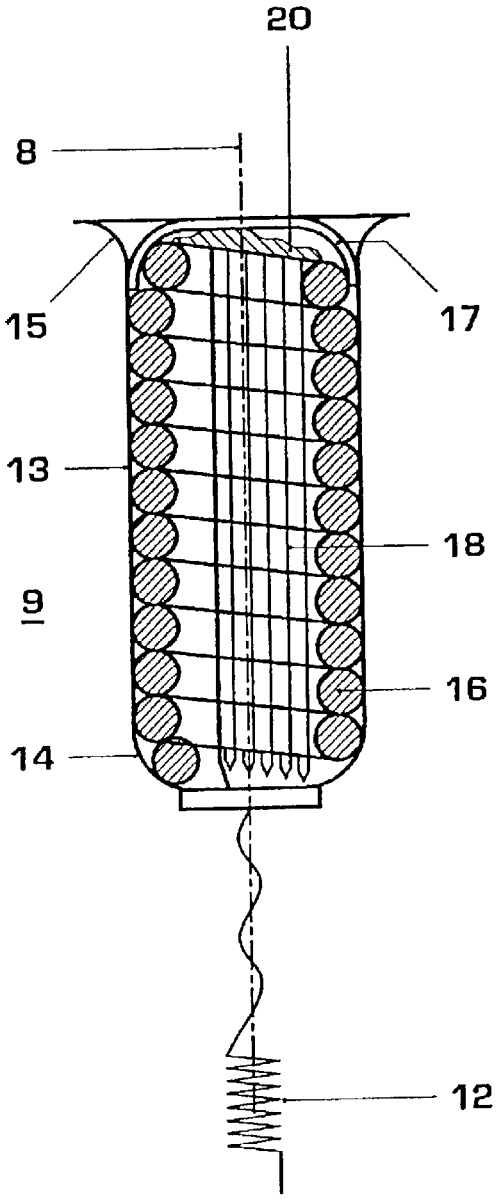
FIG. 3 shows a plan view of a second embodiment, illustrated in a partially sectioned form, of the impact signaling system as shown in FIG. 1.

The design and the method of operation of the impact signaling system can be seen from FIGS. 2 and 3. As can be seen from these figures, the impact signaling system has a generally metallic housing 13 arranged coaxially with respect to the protective device, whose lower end is in the form of a taper 14 and whose upper end is in the form of a widened region 15. A prestressed helical spring 16 is arranged in the interior of the housing 13. The lower end of the helical spring 16 is seated on the taper 14, and it is fitted at its upper moving end with an actuator 17 in the form of a cap. The force of the prestressed spring 16 is absorbed by a winding 18 of the high-resistance resistor wire 12, whose turns are passed from the moveable end of the spring to its fixed end, which is arranged at the opposite end.

In the embodiment shown in FIG. 2, the two ends of the winding 18, to which the force resulting from the prestress is applied, are fixed by a crimped element 19, and an activator 20 is provided in the interior of the housing 13, having a high-energy material, for example a mixture of 30% by weight of diguanidinium-5,5'-azotetrazolate, 3.5% by weight of guanidine nitrate and 66.5% by weight of potassium permanganate. This material decomposes at a temperature of about 177° C. and in the process releases an amount of 862 J/g of energy. The activator 20 is at least partially in thermally conductive contact with the wire winding 18 and, for manufacturing reasons, embeds at least a part of the spring 16.

If the protective device 1 is heated to about 177° C. by external (external energy) or internal (protective device current) influences, then the high-energy material decomposes and now releases energy which, if the mass that is used is suitable, is sufficient to melt the wire winding 18. The helical spring 16 can now be relieved of the load on it and its upper, moveable end passes the actuator 17 through the widened region 15 and the opening 7 (FIG. 1) out of the protective device housing 2, thus visually signaling that the impact signaling system 9 has tripped. At the same time, the actuator 17 can open the switch 10 by striking a tripping element of the switch 10, thus switching off any current flowing in the switch/protective device system.

The impact signaling system is activated when a fault current flowing in the protective device 1 is limited in that the fault current commutates into the parallel path formed by the high-resistance resistor wire 12 (once it has interrupted the low-resistance wire 4 by melting it), and now severely heating the wire. Since the activator 20 is in thermally conductive contact with the now severely heated wire winding 18, the activator is rapidly raised to the decomposition temperature of 177° C., and the winding is destroyed by the decomposing high-energy material, releasing the moving end of the helical spring 16 and with the actuator 17 being passed out of the protective device 1.

In the embodiment of the impact signaling system shown in FIG. 3, the activator 20 fixes the wire winding 18 mechanically. This is achieved by means of a small droplet of an alloy which melts at the desired limit temperature, for example $AgIn_2$ with a melting temperature of 166° C., which, in the form of a spot, fixes the wire winding 18 on the spring 16, or which fixes two sections of the winding 18 which can be moved with respect to one another. When the melting temperature of approximately 166° C. is reached, the wire winding 18 is released from the spring 16 or the moveable winding sections are separated from one another, and the turns of the winding 18 can now open, with the load on the spring at the same time being relieved.

| LIST OF REFERENCE SYMBOLS | |
|---|---|
| 1 | High-voltage protective device |
| 2 | Housing |
| 3 | Supporting body |
| 4 | Low-resistance fusible wire |
| 5, 6 | Power connections |
| 7 | Opening |
| 8 | Axis |
| 9 | Impact signaling system |
| 10 | Switch |
| 11 | Switch/protective device system |
| 12 | High-resistance resistor wire |
| 13 | Housing |

-continued

| LIST OF REFERENCE SYMBOLS | |
|---|---|
| 14 | Taper |
| 15 | Widened area |
| 16 | Spring, helical spring |
| 17 | Actuator |
| 18 | Wire winding |
| 19 | Crimp |
| 20 | Activator |

What is claimed is:

1. An impact signaling system (9) for a high-voltage protective device (1) having a housing (13), having a spring (16) which is arranged in the housing (13) and has a moveable end, having an actuator (17) which can be passed out of the housing (13) and interacts with the moveable end, having a high-resistance resistor wire (12) which is connected in parallel with a fusion wire (4) of the protective device (1), and having a holder which absorbs the prestress of the spring (16) and can be raised with the aid of an activator (20) above a limit temperature with the load on the spring (16) at the same time being relieved, characterized in that the holder contains a section of the high-resistance resistor wire (12) which is in the form of a winding (18) and is passed at least once around the moveable end of the spring (16) in order to form the prestress, and which is at least partially in thermally conductive contact with the material of the activator (20).

2. The impact signaling system as claimed in claim 1, characterized in that the activator (20) has a high-energy material with an amount of energy which can be released above the limit temperature which is sufficient to melt the wire winding (18).

3. The impact signaling system as claimed in claim 2, characterized in that the high-energy material contains a combustible material, in particular such as a guanidine or a guanidine derivative, an oxidizer which reacts with the combustible material on reaching the limit temperature releasing the energy, in particular such as a nitrate, chlorate, perchlorate and/or permanganate, possibly as well as a binding agent, in particular such as a paraffin or a polymer.

4. The impact signaling system as claimed in one of claims 2 to 4, characterized in that at least a portion of the spring (16) is embedded in the high-energy material.

5. The impact signaling system as claimed in claim 1, characterized in that the activator (20) mechanically fixes the wire winding (18).

6. The impact signaling system as claimed in claim 5, characterized in that the activator (20) is in the form of a point and fixes the wire winding (18) on the spring (16).

7. The impact signaling system as claimed in one of claims 1 to 6, characterized in that the activator (20) is formed from an alloy which melts at the limit temperature, in particular based on silver, copper and/or aluminum, doped with indium and/or germanium.

8. The impact signaling system as claimed in one of claims 1 to 7, characterized in that the spring is in the form of a helical spring (16) and is supported on the housing (13) at a fixed end which is arranged opposite the moveable end, and in that the prestress is absorbed by the wire winding (18) which is passed around the moveable end and the fixed end.

9. A high-voltage protective device (1) having an impact signaling system (9) as claimed in one of claims 1 to 8.

10. A switch/protective device system (11) having a high-voltage protective device (1) as claimed in claim 9.

* * * * *